US005797154A

United States Patent [19]

Contreras

[11] Patent Number: 5,797,154

[45] Date of Patent: Aug. 25, 1998

[54] CONTOURED PILLOW

[75] Inventor: Jose D. M. Contreras, Boothwyn, Pa.

[73] Assignee: Foamex L.P., Linwood, Pa.

[21] Appl. No.: 844,115

[22] Filed: Apr. 30, 1997

[51] Int. Cl.[6] ..... A47G 9/00

[52] U.S. Cl. ..... 5/636

[58] Field of Search ..... 5/636, 637, 640, 5/643, 644, 645; D6/601

[56] References Cited

U.S. PATENT DOCUMENTS

| | | | |
|---|---|---|---|
| D. 293,755 | 1/1988 | Murphy | D6/601 |
| D. 309,543 | 7/1990 | Goodman | D6/601 |
| D. 339,020 | 9/1993 | Ward et al. | D6/601 |
| D. 371,035 | 6/1996 | Davis | D6/601 |
| 3,775,785 | 12/1973 | Mittendorf | 5/640 |
| 3,829,917 | 8/1974 | De Laittre et al. | 5/636 |
| 4,165,125 | 8/1979 | Owen | 5/490 |
| 4,424,599 | 1/1984 | Hannouche | 5/636 |
| 4,777,678 | 10/1988 | Moore . | |
| 4,805,603 | 2/1989 | Cumberland | 5/644 |
| 4,821,355 | 4/1989 | Burkhardt | 5/636 |
| 4,914,763 | 4/1990 | Clark . | |
| 4,916,765 | 4/1990 | Castronovo, Jr. | 5/640 |
| 5,016,303 | 5/1991 | Tanaka et al. . | |
| 5,153,960 | 10/1992 | Ritter et al. | 5/640 |
| 5,237,714 | 8/1993 | Baron | 5/645 |
| 5,261,420 | 11/1993 | Grillo | 128/845 |
| 5,476,105 | 12/1995 | Toth | 128/845 |
| 5,533,218 | 7/1996 | Fahy | 5/636 |
| 5,581,832 | 12/1996 | Bridley | 5/655 |

OTHER PUBLICATIONS

Core Products Internat'l Inc. c1988, The Curl, at center and right.

*Primary Examiner*—Alexander Grosz
*Attorney, Agent, or Firm*—Connolly and Hutz

[57] ABSTRACT

The invention provides a pillow to support a user's head and neck and a portion of his upper body during sleep or resting. The pillow has a generally planar lower support surface and an upper support surface. A rear lobe and a front lobe are separated by a trough on the support surface. A wedge portion depends downwardly from the front lobe toward the front edge of the pillow. The wedge portion and front lobe together function to support the neck and a portion of the user's upper body when his head is held within and is supported by the trough.

13 Claims, 3 Drawing Sheets

CONTOURED PILLOW

FIELD OF THE INVENTION

The present invention relates generally to pillows, and more specifically to therapeutic pillows designed to position the head and upper body properly during rest or sleep, thereby avoiding or minimizing ailments of the neck and shoulders.

BACKGROUND OF THE INVENTION

Neck and shoulder pain can result from many causes, including trauma, arthritis, disc degeneration and emotional stress or tension. Pain results from the sustained contraction of the muscles, which impedes adequate blood flow, thus diminishing the supply of oxygen to the muscles and the muscle's ability to rid itself of waste products.

Improper sleeping posture can cause or contribute to neck and shoulder pain. Many pillows have been developed to improve sleeping posture. For example, U.S. Pat. No. 4,759,089, discloses a cervical pillow having a cradle element, defined between a pair of lobes, to support the head of the user. The cradle element tapers or slants downward from the rear to the front portion of the pillow. When the user rests his head atop the pillow, the slanted cradle element causes his chin to tilt toward his chest. The lobes are not intended and do not support the user's neck and shoulders.

U.S. Pat. No. 4,726,087 discloses a foam pillow having two opposing main support surfaces. The generally bottom surface has convolutions defining a relatively flat profile. The generally top surface includes longitudinal ribs of arcuate cross-section, which define a curved profile having at least two prominent lobes of differing heights and a central trough. Typically, the trough receives a users head, while the user's neck rests on and is supported by one of the lobes. The user can reverse the lobes to vary the amount of neck support. The pillow does not support any portion of the user's upper body or shoulders.

Other known pillow structures feature a combination of lobes and central trough to support the user's head and neck to improve sleep posture. None of these prior art pillow structures provide any means for supporting a user's shoulders or a portion of his upper body while resting in a supine (back-lying) position. The prior art does not show a cervical and head support pillow that maintains cervical concavity when the user is in a supine position, yet provides comfortable head, neck, and shoulder support whether the user is in either a supine position or a side-lying position.

SUMMARY OF THE INVENTION

The invention provides a pillow to support the head, neck and a portion of the upper body of a user. The pillow features a top support surface and a generally planar lower support surface. The top or upper support surface has a front lobe with an upper surface separated from a rear lobe by a trough, wherein the trough is adapted to support the head of the user. A wedge portion extends downwardly from the upper surface of the front lobe to the front edge of the pillow, generally forming an angle θ between about 15 to 60 degrees, preferably 20 to 40 degrees, as measured from the planar lower surface. The wedge and front lobe are together adapted to support the neck and a portion of the user's upper body, usually the shoulders. Preferably the upper surface of the wedge has a curved profile with a radius of curvature R in the range of about 7 to 24 inches, most preferably 10 to 12 inches. The upper surface of the pillow also may be provided with a plurality of parallel curved ridges separated by valleys or scored portions to increase air flow and user comfort.

DETAILED DESCRIPTION OF THE PREFERRED EMBODIMENTS

Figure 2:
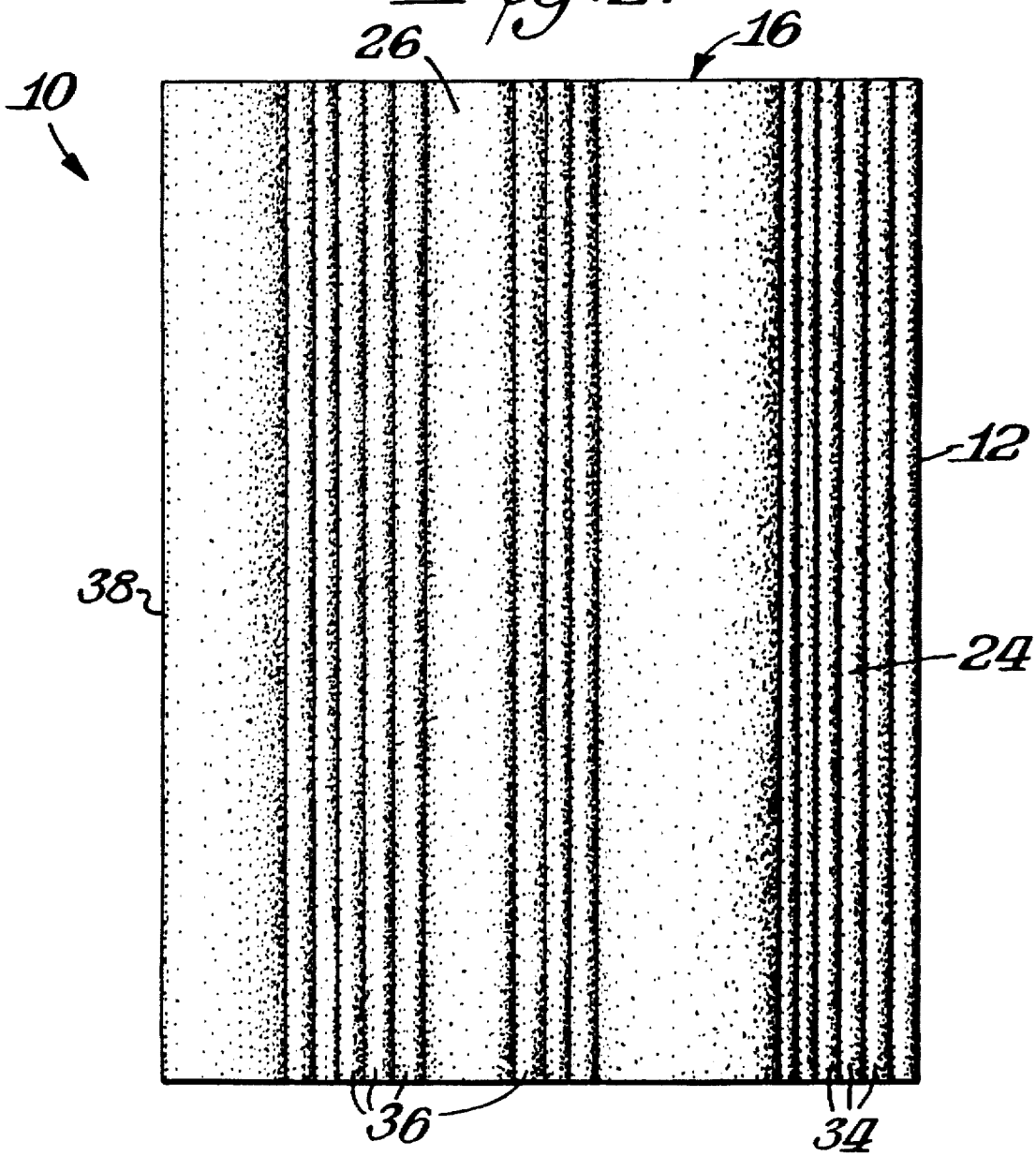
FIG. 2 is a top plan view of the pillow of FIG. 1.
Figure 1:
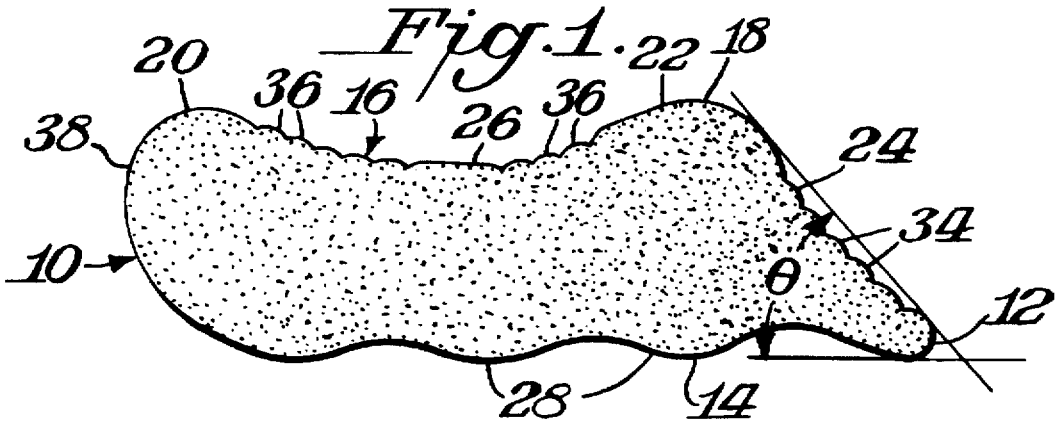
FIG. 1 is a left side elevational view of a preferred embodiment of the pillow of the invention, wherein the right side elevational view is identical.
Figure 3:
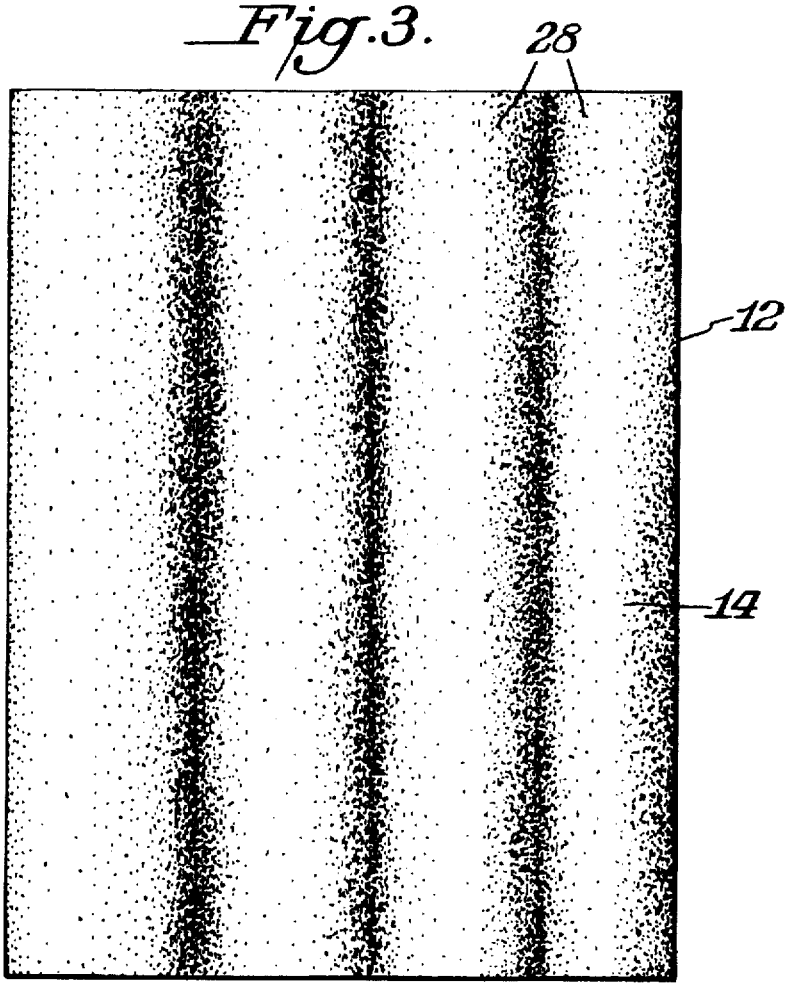
FIG. 3 is a bottom plan view of the pillow of FIG. 1.

Referring first to FIGS. 1 and 2, the pillow 10 of the present invention comprises a front edge 12, a back edge 38, a lower support surface 14 and an upper support surface 16. In the first preferred embodiment, the lower support surface has a plurality of parallel spherical edges 28, as shown in FIGS. 1, 3, 6, and 7, or other suitably shaped ridges. The lower support surface 14 is generally planar, however, wherein the upper portions of the curved ridges 28 define the plane. Preferably the curved portions of the spherical ridges 28 and the curved portions of the troughs between the ridges 18 have radii of curvature between about 2 and 3 inches.

Figure 4:
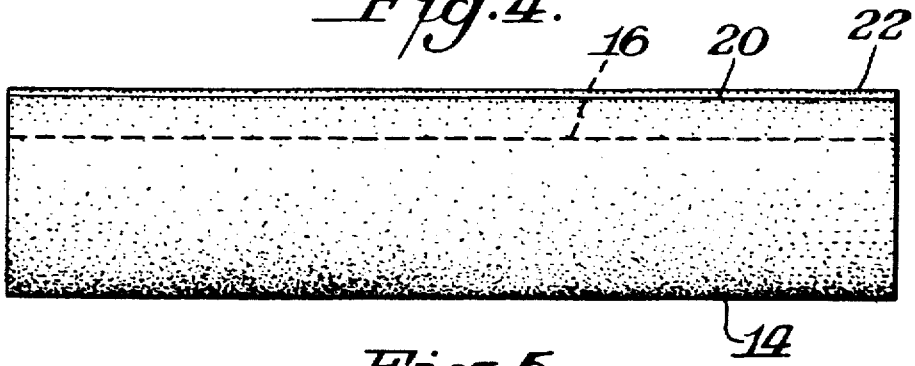
FIG. 4 is a rear elevational view.

The upper support surface 16 has a front lobe 18 and a rear lobe 20, separated by a trough 26, and a wedge portion 24, depending downwardly from the front lobe 18. As shown in FIG. 4, the front lobe 18 may be higher and thicker than the rear lobe 20. The rear lobe 20 typically has a smooth, curved shape with a radius of curvature between about 1 and 5 inches. The upper support surface 16 may be curved to form a trough between the front lobe 18 and rear lobe 20. When so curved, the radius of curvature preferably is between about 15 and 20 inches, preferably 18 inches.

The portion of the upper support surface 16 located atop the front lobe 18 defines the upper surface 22 of the front lobe 18. The wedge portion 24 extends downwardly from the upper surface 22 of the front lobe 18 to the front edge 12 of the pillow, which is located at the tip of the wedge portion 24. The wedge portion 24 may be defined by the angle the wedge portion 24 makes as measured from the plane of the lower support surface 14. This angle θ generally ranges from about 15 degrees to about 60 degrees, and is preferably about 20 to 40 degrees.

Figure 6:
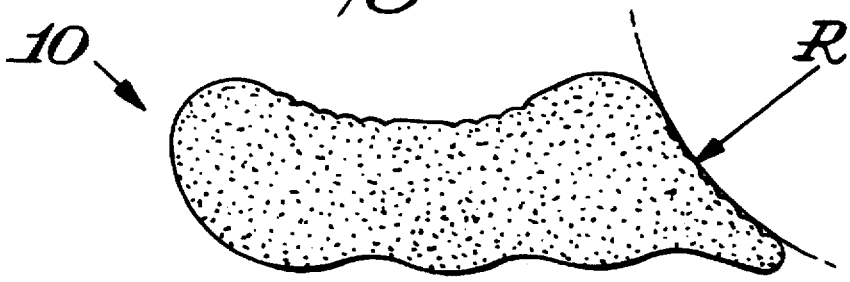
FIG. 6 is a left side view of the pillow illustrating the curvature of the wedge.
Figure 7:
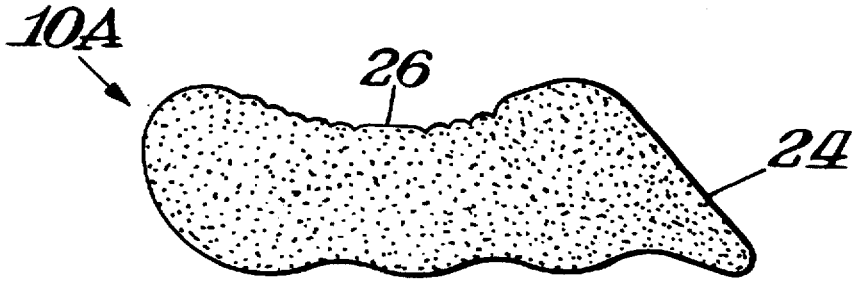
FIG. 7 is a left side view of an alternate pillow embodiment according to the invention.

The wedge portion 24 of pillow 10A, the second preferred embodiment, may have a generally flat upper surface, as shown in FIG. 7. Alternatively, and preferably, the upper surface of the wedge portion 24 is curved upwardly. As shown in FIG. 6, the radius of curvature R will generally range from about 7 to about 24 inches, and is preferably about 10 to 12 inches.

Figure 5:
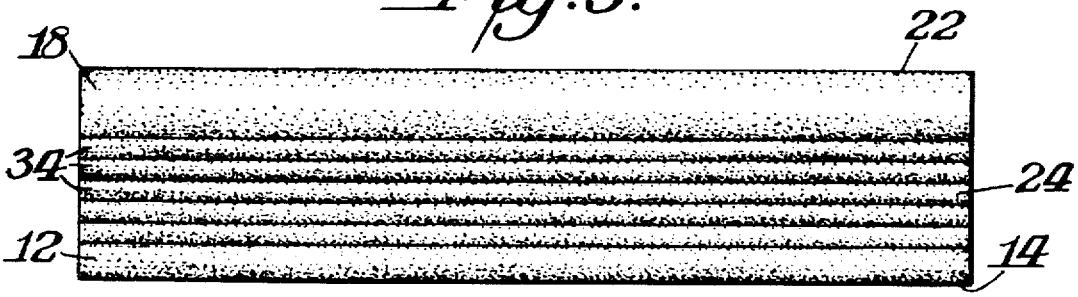
FIG. 5 is a front elevational view of the pillow of FIG. 1.

The upper surfaces of both the wedge portion 24 and the trough 26 each may define a plurality of parallel spherical ridges, designated 34 and 36, respectively. Greater air flow and circulation along the troughs or scores between the ridges increases user comfort. A preferred pattern for the ridges is shown in FIGS. 1, 2 and 5.

The trough 26 is adapted to support the head of a user, while the front lobe 18 and the wedge portion 24 serve to support the neck and a portion of the upper body of the user. The user's head and neck remain fully supported whether he rests on his side or in the supine position (on his back). In this way, the pillow helps to maintain proper sleep or resting posture of the user, thus avoiding or minimizing ailments caused by improper posture.

The length and width of the pillow preferably conform to industry pillow dimensions for king, queen and standard pillows. The thickness or height of the pillow, as measured from the top of the front lobe 18 and the outermost portion of a lower spherical ridge 14 preferably is between about 4 and 6 inches, but may be any thickness sufficient for a contoured pillow structure.

The pillow may be constructed from various cushioning materials known to those of skill in the art, such as polyurethane foam, both open-cell and reticulated, or polyethylene foam. The pillow may be a composite of a combination of materials of varying density. Preferably the pillow is constructed of a slow recovery or viscoelastic foam. Noted for slow recovery from compression, such viscoelastic foams also retain heat and when formed into a pillow comfortably compress and conform to the user's head and neck and upper body.

Persons of skill in the art will know various methods to fabricate the pillow structure of the present invention. Perhaps the simplest is to contour cut the pillow structure from a larger slab of cushioning material. If polyurethane foam is used, the pillow structure may also be formed in a mold by pouring the foam-forming ingredients into the mold and so that the foam forms within the mold. The structure may also be formed by compression cutting a larger slab of cushioning material.

While preferred embodiments of the invention have been described using specific terms, the description has been for illustrative purposes only. Changes and variations may be made without departing from the spirit or scope of the invention, which is defined by the following claims.

I claim:

1. An integral one piece pillow to support the head, neck and a portion of the upper body of a user, comprising:

a front edge;

a generally planar lower support surface;

an upper support surface having a front lobe with an upper surface separated from a rear lobe having a back edge by a trough, wherein the trough is adapted to support the head of a user, and having a wedge potion extending downwardly from the upper surface of the front lobe to the front edge of the pillow, said wedge portion having a concavely curved upper surface, wherein the wedge and front lobe are together adapted to support the neck and a portion of the user's upper body and the front edge is generally parallel to the back edge of the rear lobe.

2. The pillow of claim 1, wherein the upper surface of the wedge portion is disposed at an angle of between about 15 to 60 degrees as measured from the generally planar lower support surface.

3. The pillow of claim 2, wherein the upper surface of the wedge portion is disposed at an angle of between about 20 to 40 degrees as measured from the generally planar lower support surface.

4. The pillow of claim 3, wherein the radius of curvature defining the concavely curved upper surface of the wedge portion is between about 7 and 24 inches.

5. The pillow of claim 4, wherein the concavely curved upper surface of the wedge portion is defined by a radius of curvature in the range of about 10 to 12 inches.

6. The pillow of claim 2, further comprising a plurality of parallel convexly curved ridges formed on the upper surface of the wedge portion.

7. The pillow of claim 2, wherein the pillow is constructed from a material or composites of materials selected from the group consisting of: open-cell polyurethane foam, reticulated polyurethane foam, viscoelastic foam and polyethylene foam.

8. The pillow of claim 1, wherein the concavely curved upper surface of the wedge portion is defined by a radius of curvature in the range of about 7 to 24 inches.

9. The pillow of claim 8, wherein the pillow is constructed from a material or composites of materials selected from the group consisting of: open-cell polyurethane foam, reticulated polyurethane foam, viscoelastic foam and polyethylene foam.

10. The pillow of claim 8, wherein the concavely curved upper surface of the wedge portion is defined by a radius of curvature in the range of about 10 to 12 inches.

11. The pillow of claim 1, further comprising a plurality of parallel convexly curved ridges formed on the upper surface of the trough.

12. The pillow of claim 1, further comprising a plurality of curved ridges formed on the lower support surface, wherein the outer portion of the ridges define a plane.

13. The pillow of claim 1, wherein the pillow is constructed from a material or composites of materials selected from the group consisting of: open-cell polyurethane foam, reticulated polyurethane foam, viscoelastic foam and polyethylene foam.

* * * * *

UNITED STATES PATENT AND TRADEMARK OFFICE

CERTIFICATE OF CORRECTION

PATENT NO. : 5,797,154

DATED : August 25, 1998

INVENTOR(S) : Jose D. M. Contreras

It is certified that error appears in the above-identified patent and that said Letters Patent is hereby corrected as shown below:

Claim 1, at Column 3, line 47, "potion" should read -- portion --.

Claim 12, at Column 4, line 43, "portion" should read -- portions --.

Signed and Sealed this

Fifth Day of January, 1999

*Attest:*

*Attesting Officer*

*Acting Commissioner of Patents and Trademarks*